United States Patent [19]

Evans, Sr.

[11] 4,257,591

[45] Mar. 24, 1981

[54] ELONGATED EXERCISING DEVICE OF VARIABLE LENGTH

[76] Inventor: Kenzell Evans, Sr., 2320 Chester St. SE., #202, Washington, D.C. 20020

[21] Appl. No.: 921,185

[22] Filed: Jul. 3, 1978

[51] Int. Cl.[3] ..... A63B 21/00

[52] U.S. Cl. ..... 272/125; 272/143; 272/DIG. 4

[58] Field of Search ..... 272/109, 143, 128, 122, 272/123, 67, 68, 125, 1, DIG. 3, DIG. 4, 141, 103, 118, 137, 126; 403/108, 378, 379, 324, 316

[56] References Cited

U.S. PATENT DOCUMENTS

| | | | |
|---|---|---|---|
| 1,012,802 | 12/1911 | Brogan | 272/125 |
| 1,023,756 | 4/1912 | Pons | 272/141 |
| 1,297,995 | 3/1919 | Bralove | 403/379 |
| 1,714,391 | 5/1929 | McWhirter | 272/123 |
| 2,484,401 | 10/1949 | Coie | 403/108 X |
| 2,896,982 | 7/1959 | Wallace | 403/108 |
| 3,366,381 | 1/1968 | Ross | 272/103 |
| 3,451,675 | 6/1969 | Burzenski | 272/137 |
| 3,627,315 | 12/1971 | Marcyan | 272/118 |
| 3,820,781 | 6/1974 | Kane | 272/126 |
| 3,884,464 | 5/1975 | Evangelos | 272/126 X |

*Primary Examiner*—William R. Browne

[57] ABSTRACT

An exercise device comprised of a plurality of sections which cooperate to form an elongated shaft of variable length. The ends of the elongated shaft include hand grips which are perpendicular to the elongated shaft. A separate rotatable gripping shaft is mounted to extend internally of the generally D-shaped frame member and oriented so as to be perpendicular to the length of the elongated shaft. Pin members that are T-shaped are used to be inserted into aligned holes in a mid section and end section of the elongated shaft to fixedly hold the sections together. A spring is connected to the top cross portion of the T-shaped member and the opposite end of the spring is connected to the base part of the T-shaped member.

4 Claims, 4 Drawing Figures

ELONGATED EXERCISING DEVICE OF VARIABLE LENGTH

BACKGROUND OF THE INVENTION

This invention relates to an exercise device which comprises an elongated shaft or bar which in use is placed behind the nape of the neck and facilitates extension of the arms substantially horizontally in relation to the torso. The invention is more particularly concerned with an exercise device of the above general character with provision for gripping means at the ends of the elongated shaft or bar.

Prior art exercise devices, as exemplified by U.S. Pat. No. 3,820,781 issued to John F. Kane, entail the use of a straight exercise bar or, as presented in the Kane Patent, an exercise bar with a yoke portion to fit around the nape portion of the neck of the exerciser. In either instance the arms, as substantially horizontally extended, are draped over the bar at the elbow or mid-portion of the forearm. The weight of the arm and the additional pressure of engagement during flexure and twisting of the torso while exercising operate to cut off the circulation of blood to the lower forearm. This circulatory constriction during exercise operates to numb the lower extremities of the arm and defeats the object of the excercise, i.e., increased blood circulation and muscle toning.

SUMMARY OF THE INVENTION

Accordingly it is an object of the present invention to provide an exercise device comprising an elongated bar with gripping means provided at the outer extremities of the bar to eliminate the contacting of the extended arm with the bar in a manner which constricts circulation in the arm.

Another object of the invention is the provision of gripping means at the outer extremities of the bar to prevent slippage of the bar during exercising and additionally to provide a means for isometric exercising.

A further object of the invention is to provide a sheath of fabric or other like material which is soft relative to the bar portion to prevent abrasion or general discomfort to the exerciser in the area generally defined as the nape of the neck.

Briefly, the invention in its broadest aspect comprises a plurality of sections which cooperate or interengage to form an elongated shaft of variable length, the ends of the shaft having a gripping means which are perpendicular to the elongated shaft.

Further objects, advantages, and features of the invention will be apparent in the arrangement and construction of the constituent parts in detail as set forth in the following specification taken together with the accompanying drawing.

DESCRIPTION OF THE DRAWING

In the drawing,

Referring to FIG. 2, the exercise device is shown in exploded view. The shaft sections 10, 12 and 14 cooperate to form the elongated shaft. The sections can be fabricated from aluminum, plastic or other like lightweight rigid material. Mid section 10 is sheathed with fabric, styrofoam rubber or other like resilient material 16 in the area which contacts the back of the neck during exercising. The resilient sheathing 16 protects the skin from abrasion in the areas which contact with the bar during exercising. The distal ends of the mid section 10 have a series of holes 18 which are approximately at one (1) inch intervals along the shaft. The end sections 12 and 14 cooperate and interengage with mid section 10 to form an elongated shaft of variable length. The proximal ends of the end sections 12 and 14 relative to mid section 10 have a series of holes 20 which are at approximately one (1) inch intervals along the shaft. The diameters of the shafts which form the end sections 12 and 14 are smaller than the diameter of mid section 10 such that the end section shafts may be slidably engaged into the mid section 10 shaft.

Figure 1:
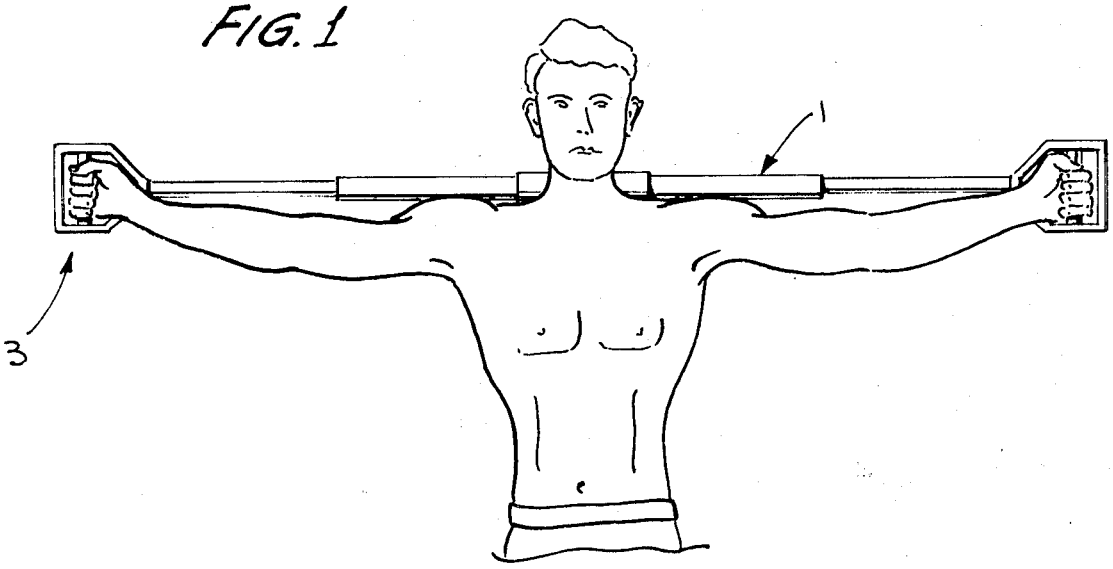
FIG. 1 demonstrates the exercise device in position for use.
Figure 2:
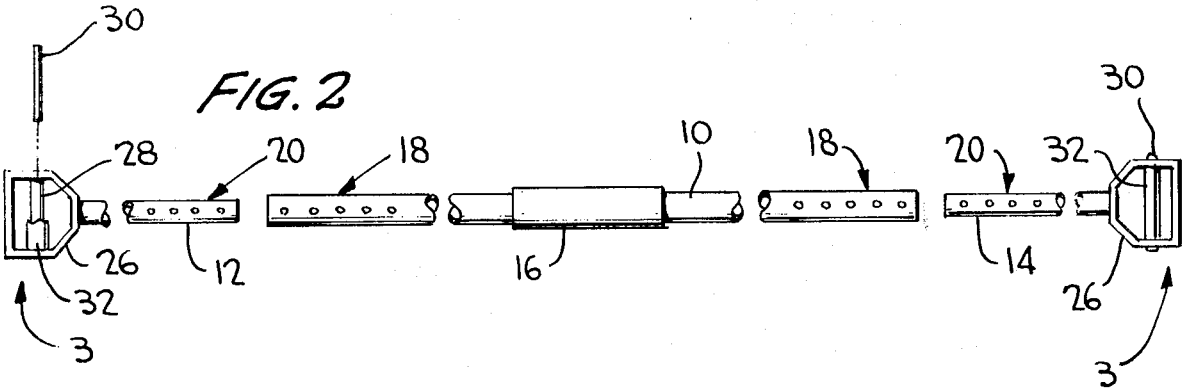
FIG. 2 is an exploded view of the preferred embodiment of the exercise device.
Figure 3:
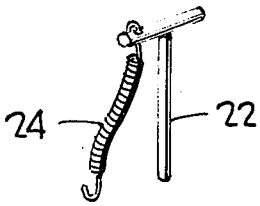
FIG. 3 is a view of the spring bias pin.
Figure 4:
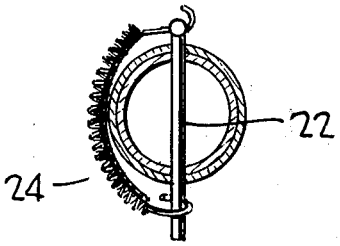
FIG. 4 is a cross sectional view of the spring bias pin as engaged to fix the shaft sections.

The length of the exercise device in accordance with the arm span of the individual exerciser can be rigidly fixed by slidably engaging the end sections 12 and 14 into the mid section shaft 10 and aligning the holes 18 and 20. A spring biased pin 22 shown in FIG. 3 is then placed through the aligned holes to rigidly fix the length of the elongated shaft. A spring 24 is attached to pin 22 which maintains the positioning of the pin 22 in the aligned holes as shown in FIG. 4.

The distal ends of end sections 12 and 14 have a hand gripping means indicated at 3. Attached to the distal end of each end section 12 and 14 is a frame member 26. The plane defined by the frame member is substantially perpendicular to the shaft of each end section 12 and 14. A hand grip 28 is rotatably affixed to the frame 26 by a rivet pin 30 which cooperates with holes on opposing sides of the frame. The hand grip 28 may be sheathed with fabric or other like absorbant material to absorb perspiration and generally operate to make the grip more comfortable to grasp. After the exercise device is positioned at the appropriate length for the individual exerciser, the elongated bar is placed behind the neck and the exerciser grasps the hand grips 28 in either a palms in or palms out orientation. The exerciser then swings to and fro and/or dips each hand respectively in an exercising regime. The bar maintains the arms in an outstretched position and minimizes the twisting and flexure of the torso muscles.

While there has been shown and described what is considered to be a preferred embodiment of the present invention, it will be obvious to those skilled in the art that various changes and modifications may be made therein without departing from the invention as defined in the appended claims.

I claim:

1. An exercising device which comprises a plurality of elongated sections which are interconnected to one another to form an elongated shaft of variable length, said sections including a hollow mid section and two end sections, said hollow mid section having a series of aligned holes extending through the distal ends thereof, and said end sections having a series of aligned holes extending therethrough, said end sections having cross-sectional dimensions less than the cross sectional dimension of said mid section so as to be sideably positionable within a respective distal end of said mid section to vary the length of said elongated shaft;

pin members for interengaging the aligned holes in said end sections with respective aligned holes in said mid section so as to maintain the length of said elongated shaft at a fixed desired length, said pin members being T-shaped so as to have a top cross part and a base part, with the base part of each T-shaped pin member having a greater length than the diameter of said mid section such that when the base part of each T-shaped pin member is fitted through the aligned holes of said mid section and said end sections, said base part of each T-shaped pin member will extend outwardly beyond said sections, each said pin member including a spring having one end attached to a top cross part of the respective T-shaped pin member and a second end connectable to the portion of the base part of the respective T-shaped pin member which extends beyond said sections when the respective T-shaped pin member is fitted through the aligned holes of said mid section and the respective end section; and gripping means fixedly connected to the respective ends of said end sections which are remote from said mid section, each said gripping means comprising a generally D-shaped frame member and a separate rotatable gripping shaft mounted to extend internally of said generally D-shaped frame member and oriented so as to be perpendicular to the length of said elongated shaft.

2. The exercising device of claim 1 wherein said mid section includes a resilient material wrapped therearound for the prevention of skin abrasion when the exercising device is in use.

3. The exercising device of claim 1 wherein each said gripping shaft of each gripping means is sheathed with an absorbant material.

4. The exercising device of claim 1 wherein the second end of each spring connected to each T-shaped pin member is hook shaped.

* * * * *